US011447727B2

(12) United States Patent
Piorkowski

(10) Patent No.: US 11,447,727 B2
(45) Date of Patent: Sep. 20, 2022

(54) USE OF SURFACTANT BLEND TO CONTROL RHEOLOGY OF UNIT DOSE OR LIQUID LAUNDRY DETERGENT

(71) Applicant: Henkel AG & Co. KGaA, Duesseldorf (DE)

(72) Inventor: Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 47 days.

(21) Appl. No.: 16/777,380

(22) Filed: Jan. 30, 2020

(65) Prior Publication Data

US 2021/0238512 A1 Aug. 5, 2021

(51) Int. Cl.

| | |
|---|---|
| ***C11D 1/22*** | (2006.01) |
| ***C11D 1/26*** | (2006.01) |
| ***C11D 1/29*** | (2006.01) |
| ***C11D 1/72*** | (2006.01) |
| ***C11D 1/83*** | (2006.01) |
| ***C11D 3/37*** | (2006.01) |
| ***C11D 17/04*** | (2006.01) |
| ***C11D 1/14*** | (2006.01) |
| ***C11D 3/20*** | (2006.01) |

(52) U.S. Cl.

CPC ..... *C11D 17/043* (2013.01); *C11D 1/143* (2013.01); *C11D 1/29* (2013.01); *C11D 1/72* (2013.01); *C11D 1/83* (2013.01); *C11D 3/2068* (2013.01); *C11D 3/3707* (2013.01)

(58) Field of Classification Search

CPC .... C11D 1/22; C11D 1/26; C11D 1/29; C11D 1/72; C11D 1/83; C11D 3/2041; C11D 3/2068; C11D 3/3707; C11D 17/042

See application file for complete search history.

(56) References Cited

U.S. PATENT DOCUMENTS

| | | | | |
|---|---|---|---|---|
| 4,622,173 | A | 11/1986 | Broze et al. | |
| 5,102,573 | A | 4/1992 | Han | |
| 10,774,294 | B2 * | 9/2020 | Piorkowski | C11D 3/43 |
| 11,046,915 | B2 * | 6/2021 | Piorkowski | C11D 17/043 |
| 2018/0216034 | A1 | 8/2018 | Camire et al. | |
| 2018/0265825 | A1 | 9/2018 | Park | |
| 2018/0334641 | A1 * | 11/2018 | Piorkowski | C11D 3/43 |
| 2019/0169118 | A1 | 6/2019 | Piorkowski et al. | |
| 2019/0169535 | A1 | 6/2019 | Piorkowski et al. | |

FOREIGN PATENT DOCUMENTS

| | | | | |
|---|---|---|---|---|
| EP | 3101102 | * | 12/2016 | C11D 1/22 |
| EP | 3101102 | A1 | 12/2016 | |

* cited by examiner

*Primary Examiner* — Brian P Mruk

(74) *Attorney, Agent, or Firm* — Bojuan Deng

(57) ABSTRACT

A unit dose detergent pack includes a pouch made of a water-soluble film and a detergent composition encapsulated within the pouch, wherein the detergent composition includes a surfactant component including (1) an alcohol ethoxy sulfate having a $C_8$-$C_{20}$ backbone that is ethoxylated with from about 1 to about 10 moles of ethylene oxide, (2) at least one non-ionic surfactant having an alkoxylated alcohol, and (3) at least one anionic surfactant having a linear alkylbenzene sulfonate wherein (1), (2), and (3) are present in a weight ratio of actives of about (0 to 0.5):(0.05 to 0.9):(0 to 0.75). The detergent composition also includes water and a rheology control agent and has a viscosity of less than about 7,500 cps at 75° F. when diluted with additional water.

12 Claims, 4 Drawing Sheets

USE OF SURFACTANT BLEND TO CONTROL RHEOLOGY OF UNIT DOSE OR LIQUID LAUNDRY DETERGENT

FIELD OF THE INVENTION

The present disclosure generally relates to a detergent composition which may be a unit dose or a liquid laundry composition. More specifically, the disclosure relates to a detergent composition that includes a particular combination of surfactants at particular weight ratios of actives which facilitates formation of ultra-concentrated compositions.

BACKGROUND OF THE INVENTION

Ultra-concentrated detergents are commercially successful due to a reduction of water in the detergent which reduces shipping weight, improves product counts on pallets for shipping and shelving, and enables higher amounts of dose per unit volume for the consumer. To concentrate detergents, water is typically removed and then backfilled with surfactants, performance polymers, and enzymes. However, surfactants can only be concentrated until a certain active level until they become too thick. This thickening can happen as the actual liquid detergent which is sold to the consumer or when the product is diluted with water which is indicative of poor dilution rheology control. Thick liquid detergents are unappealing to the consumer due to their difficulty in use. During the storage of the ultra-concentrated detergent compositions, crystals/solid may form.

For example, detergent compositions that that include sodium laureth sulfate are known to be potentially difficult to work with because of a potential solubility issue. For example, such detergent compositions can have viscosities upon dilution with water that approach 400 Pa. S when measured at a shear rate of 0.42 l/sec using commonly available rheometers, which may cause the surfactants do not homogeneously disperse in water and affect their cleaning effectiveness. Accordingly, there remains an opportunity for improvement. Furthermore, other desirable features and characteristics of the present disclosure will become apparent from the subsequent detailed description of the disclosure and the appended claims, taken in conjunction this background of the disclosure.

BRIEF SUMMARY OF THE INVENTION

This disclosure provides a unit dose detergent pack that includes a pouch made of a water-soluble film and a detergent composition encapsulated within the pouch, wherein the detergent composition includes a surfactant component present in an amount of about 55 to about 85 weight percent actives based on a total weight of the detergent composition and including (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol, and (3) at least one anionic surfactant including a linear alkylbenzene sulfonate. (1), (2), and (3) are present in a weight ratio of actives of about (0 to 0.5):(0.05 to 0.9):(0 to 0.75), so long as at least two of (1), (2), and (3) are each present in an amount of greater than zero. The detergent composition also includes water present in a total amount of from about 5 to about 15 weight percent based on a total weight of the detergent composition and a rheology control agent present in an amount of from about 2 to about 15 weight percent actives based on a total weight of the detergent composition. Moreover, the detergent composition has a viscosity of less than about 7,500 cps at 75° F. when diluted with additional water at about a 1:1 weight ratio of detergent composition:water.

This disclosure also provides the detergent composition itself and a unit dose detergent pack including a pouch made of a water-soluble film and the detergent composition described above that is encapsulated within the pouch. This disclosure further provides a liquid laundry detergent.

The detergent composition exhibits superior and unexpected results. More specifically, it was discovered that a particular combination of surfactants at particular weight ratios of actives allows for ultra-concentration of a detergent without difficulty in handling during a wash process, e.g. a 44% active surfactant detergent used at 18.8 grams (such as for a unit dose) can be concentrated to about 65 to about 75% active surfactant used at about 11 grams per dose. This unexpectedly allows for concentration of the detergent by increasing active surfactant level and by lowering water and solvent level. For example, in various embodiments, this approach delivers the same amount of surfactants to the wash water in both 18.8 gram and 11 gram pacs due the higher active level in the 11 gram pac.

BRIEF DESCRIPTION OF THE DRAWINGS

The present disclosure will hereinafter be described in conjunction with the following Figures, wherein.

DETAILED DESCRIPTION OF THE INVENTION

Figure 1:
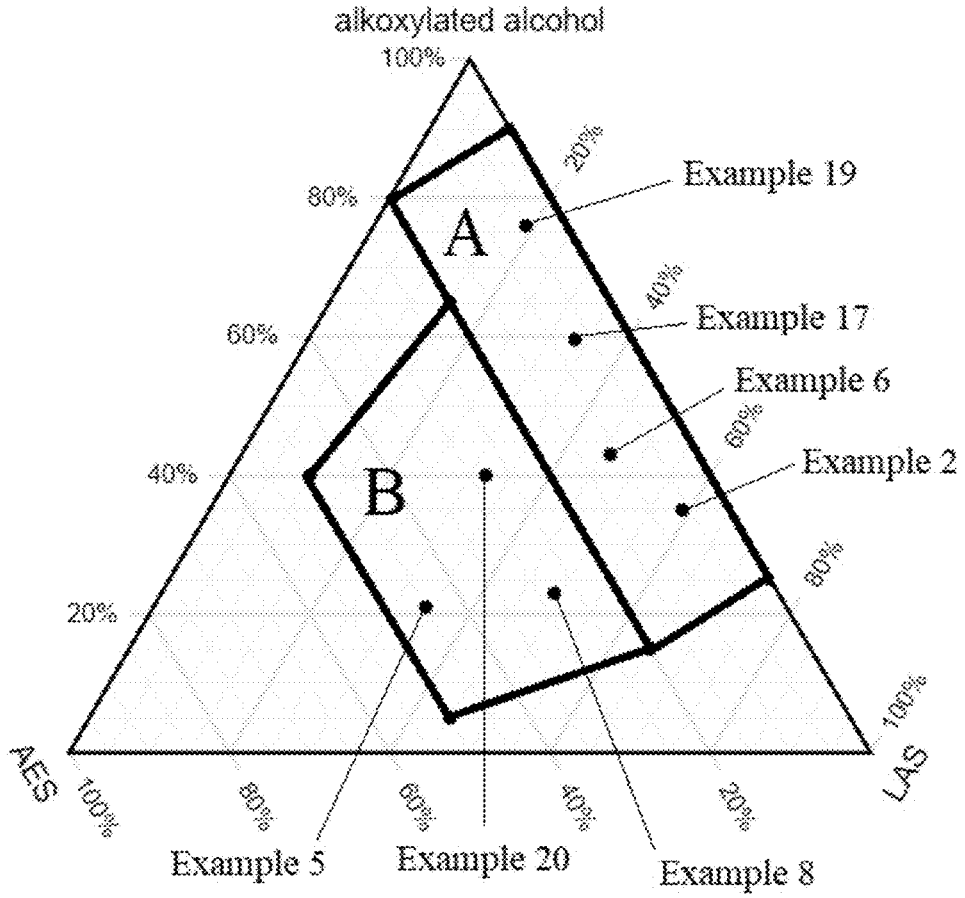
FIG. 1 is a ternary plot of weight ratios of actives of three surfactants of the surfactant component of the instant disclosure showing a four-sided region (A) and a four-sided region (B) that is further described in the Examples and also showing various individual examples.

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

This disclosure provides a unit dose detergent pack that includes a pouch made of a water-soluble film and a detergent composition encapsulated within the pouch. The detergent composition includes a surfactant component present in an amount of about 55 to about 85 weight percent actives based on a total weight of the detergent composition and including (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol, and (3) at least one anionic surfactant including a linear alkylbenzene sulfonate. (1), (2), and (3) are present in a weight ratio of actives of about (0 to 0.5):(0.05 to 0.9):(0 to 0.75), so long as at least two of (1), (2), and (3) are each present in an amount of greater than zero. The detergent composition also includes water present in a total amount of from about 5 to about 15 weight percent based on a total weight of the detergent composition and a rheology control agent present in an amount of from about 2 to about 15 weight percent actives based on a total weight of the detergent composition. Moreover, the detergent composition has a viscosity of less than about 7,500 cps at 75° F. when diluted with additional water at about a 1:1 weight ratio of detergent composition:water.

In one aspect, the present disclosure provides a detergent composition with a consistent, low viscosity profile during hydration and dissolution. The detergent composition may be used in the unit dose pack detergent product or as a liquid laundry detergent product.

In another aspect, the present disclosure provides a method for modifying rheology of a detergent composition. The method includes the step of providing a detergent composition that includes the aforementioned components. The method also includes the step of diluting the detergent composition with additional water such that the detergent composition has a viscosity of less than about 7,500 cps at 75° F. when diluted with additional water at about a 1:1 weight ratio of detergent composition:water.

It was also unexpectedly discovered that incorporation of the particular surfactant combination in a detergent composition keeps the viscosity of the detergent composition low upon dilution with water, compared to when other surfactants, or no surfactant, are added. The consistent, low viscosity profile is advantageous for dissolution when it is used in a washing machine in both unit dose and liquid laundry applications.

Detergent Composition

This disclosure provides the detergent composition, first introduced above and hereinafter referred to as a composition. The composition may be, include, consist essentially of, or consist of, the surfactant component, water, and the rheology control agent, as each is described below, e.g. in any one or more of the amounts described in greater detail below.

In one embodiment, the composition comprises the surfactant component, water, and the rheology control agent.

In another embodiment, the composition consists essentially of the surfactant component, water, and the rheology control agent.

In still another embodiment, the composition consists of the surfactant component, water, and the rheology control agent.

In yet another embodiment, the composition comprises the surfactant component, water, the rheology control agent, and one or more optional additives described below.

In another embodiment, the composition consists essentially of the surfactant component, water, the rheology control agent, and one or more optional additives described below.

In another embodiment, the composition consists of the surfactant component, water, the rheology control agent, and one or more optional additives described below.

In further embodiments, the composition is free of, or includes less than 1, 0.5, 0.1, 0.05, or 0.01, weight percent of, any one or more of the optional components or additives described above or below.

Surfactant Component

As first introduced above, the composition includes the surfactant component. The surfactant component includes, is, consists essentially of, or consists of, (1) an alcohol ethoxy sulfate having a $C_5$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

In one embodiment, the surfactant component includes (1) an alcohol ethoxy sulfate having a $C_5$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

In another embodiment, the surfactant component consists essentially of (1) an alcohol ethoxy sulfate having a $C_5$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

In a further embodiment, the surfactant component consists of (1) an alcohol ethoxy sulfate having a $C_5$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

The surfactants (1), (2), and (3) are present in a weight ratio of actives of about (0 to 0.5):(0.05 to 0.9):(0 to 0.75), so long as at least two of (1), (2), and (3) are each present in an amount of greater than zero. Accordingly, surfactant (1), which is the alcohol ethoxy sulfate may be present in an amount of the aforementioned ratio of about 0, 0.5, 0.1, 0.15, 0.2, 0.25, 0.3, 0.35, 0.4, 0.45, or 0.5. Moreover, surfactant (2), which is the at least one non-ionic surfactant may be present in an amount of the aforementioned ratio of about 0.05, 0.1, 0.5, 0.1, 0.15, 0.2, 0.25, 0.3, 0.35, 0.4, 0.45, 0.5, 0.55, 0.6, 0.65, 0.7, 0.75, 0.8, 0.85, or 0.9. Furthermore, surfactant (3), which is the at least one anionic surfactant, may be present in an amount of the aforementioned ratio of about 0, 0.05, 0.1, 0.15, 0.2, 0.25, 0.3, 0.35, 0.4, 0.45, 0.5, 0.55, 0.6, 0.65, 0.7, or 0.75. In addition, at least two of surfactants (1), (2), and (3) must be present. This means that two of the surfactants cannot be present in an amount of zero. For example, the surfactant component includes surfactants (1), (2), and (3); or (1) and (2) without (3), or (1) and (3) without (2), or (2) and (3), without (1). In various non-limiting embodiments, all values, both whole and fractional, between and including all of the above, are hereby expressly contemplated for use herein.

In one embodiment, the weight ratio of actives of (1), (2), and (3) falls within a four-sided region (A) of a ternary plot of FIG. 1, wherein the four-sided region (A) is defined by four points of the ratio of (1):(2):(3) as follows:

(i) (0):(0.9):(0.1);
(ii) (0.2):(0.8):(0);
(iii) (0.2):(0.15):(0.65); and
(iv) (0):(0.25):(0.75).

Notably the roman numerals (i), (ii), (iii), and (iv) do not specifically correspond to surfactants (1), (2), and (3).

In another embodiment, the weight ratio of actives of (1), (2), and (3) falls within a four-sided region (B) of a ternary plot of FIG. 1, wherein the four-sided region (B) is defined by four points of the ratio of (1):(2):(3) as follows:

(v) (0.2):(0.65):(0.15);
(vi) (0.5):(0.4):(0.1);
(vii) (0.5):(0.05):(0.45); and
(viii) (0.2):(0.15):(0.65).

Notably, the roman numerals (v), (vi), (vii), and (viii) do not specifically correspond to surfactants (1), (2), and (3).

In one embodiment, the weight ratio of actives of (1), (2), and (3) are: (0.05):(0.76):(0.19). In another embodiment, the weight ratio of actives of (1), (2), and (3) are: (0.07):(0.59):(0.33). In another embodiment, the weight ratio of actives of (1), (2), and (3) are: (0.11):(0.43):(0.46). In another embodiment, the weight ratio of actives of (1), (2), and (3) are: (0.06):(0.35):(0.59). In another embodiment, the weight ratio of actives of (1), (2), and (3) are: (0.28):(0.40):(0.32). In another embodiment, the weight ratio of actives of (1), (2), and (3) are: (0.28):(0.23):(0.49). In another embodiment, the weight ratio of actives of (1), (2), and (3) are: (0.45):(0.21):(0.34). Each of these points is also shown in FIG. 1. It is contemplated that the weight ratios of the active of (1), (2), and (3) may fall anywhere within the ternary plot shown in FIG. 1 or anywhere within the four-sided figure set forth in FIG. 1. In various non-limiting embodiments, all values, both whole and fractional, between and including all of the above, are hereby expressly contemplated for use herein.

The surfactant component is present in an amount of about 55 to about 85 weight percent actives based on a total weight of the detergent composition. In various embodiments, this amount is from about 60 to about 80, about 60 to about 85, about 65 to about 80, about 70 to about 75, about 65 to about 75, about 70 to about 80, etc., weight percent actives based on a total weight of the detergent composition. In various non-limiting embodiments, all values, both whole and fractional, between and including all of the above, are hereby expressly contemplated for use herein.

Alcohol Ether Sulfate

The surfactant component includes the (1) alcohol ethoxy sulfate, which may be described as an anionic surfactant. The alcohol ethoxy sulfate has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the surfactant component may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide. In various non-limiting embodiments, all values, both whole and fractional, between and including all of the above, are hereby expressly contemplated for use herein.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide. In various non-limiting embodiments, all values, both whole and fractional, between and including all of the above, are hereby expressly contemplated for use herein.

At Least One Non-Ionic Surfactant Including an Alkoxylated Alcohol:

The surfactant component also includes the (2) at least one non-ionic surfactant that includes, is, consists essentially of, or consists of, an alkoxylated alcohol. The terminology "at least one" means that one or more than one non-ionic surfactant may be utilized herein.

In one embodiment, the non-ionic surfactant includes an alkoxylated alcohol.

In one embodiment, the non-ionic surfactant consists essentially of an alkoxylated alcohol.

In one embodiment, the non-ionic surfactant consists of, an alkoxylated alcohol.

The alkoxylated alcohol may be a $C_8$-$C_{20}$ alcohol that is capped with (or comprises) approximately 2 to 12 moles of an alkylene oxide. In other embodiments, the alkoxylated alcohol may be an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein.

At Least One Anionic Surfactant Including a Linear Alkylbenzene Sulfonate

The surfactant component also includes at least one anionic surfactant that includes, is, consists essentially of, or consists of, a linear alkylbenzene sulfonate (LAS). The terminology "at least one" means that one or more than one anionic surfactant may be utilized herein.

In one embodiment, the at least one anionic surfactant includes a linear alkylbenzene sulfonate (LAS).

In one embodiment, the at least one anionic surfactant consists essentially of a linear alkylbenzene sulfonate (LAS).

In one embodiment, the at least one anionic surfactant consists of a linear alkylbenzene sulfonate (LAS).

The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. In various non-limiting embodiments, all values, both whole and fractional, between and including all of the above, are hereby expressly contemplated for use herein.

In one embodiment, the alcohol ethoxy sulfate is sodium laureth sulfate ethoxylated with about 2 to about 4 moles of ethylene oxide, the linear alkyl benzenesulfonate has a linear alkyl chain that has from about 10 to about 13 carbon atoms, and the alkoxylated alcohol is an ethoxylated alcohol including a $C_8$-$C_{20}$ backbone that is ethoxylated with from about 2 to about 12 moles of ethylene oxide.

In another embodiment, the (1) alcohol ethoxy sulfate is sodium laureth sulfate ethoxylated with about 2 to about 4 moles of ethylene oxide, the (2) alkoxylated alcohol is a C12-C15 alcohol ethoxylate that is capped with approximately 7 moles of ethylene oxide; and the (3) linear alkyl benzenesulfonate is 2-Phenyl Sulfonic Acid, and the weight ratio of actives of (1), (2), and (3) falls within a four-sided region (A) of a ternary plot of FIG. 1, wherein the four-sided region (A) is defined by four points of the ratio of (1):(2):(3) as follows: (i) (0):(0.9):(0.1); (ii) (0.2):(0.8):(0); (iii) (0.2):(0.15):(0.65); and (iv) (0):(0.25):(0.75). In various non-limiting embodiments, all values, both whole and fractional, between and including all of the above within the five-sided region, are hereby expressly contemplated for use herein.

In a further embodiment, the (1) alcohol ethoxy sulfate is sodium laureth sulfate ethoxylated with about 2 to about 4 moles of ethylene oxide, the (2) alkoxylated alcohol is a C12-C15 alcohol ethoxylate that is capped with approximately 7 moles of ethylene oxide; and the (3) linear alkyl benzenesulfonate is 2-Phenyl Sulfonic Acid, and the weight ratio of actives of (1), (2), and (3) falls within a four-sided region (B) of a ternary plot of FIG. 1, wherein the four-sided region (B) is defined by four points of the ratio of (1):(2):(3) as follows: (v) (0.2):(0.65):(0.15); (vi) (0.5):(0.4):(0.1); (vii) (0.5):(0.05):(0.45); and (viii) (0.2):(0.15):(0.65). In various non-limiting embodiments, all values, both whole and fractional, between and including all of the above within the three-sided region, are hereby expressly contemplated for use herein.

Additional Surfactants

In other embodiments, one or more additional surfactants may be utilized and may be or include cationic, anionic, non-ionic, and/or zwitterionic surfactants, and/or combinations thereof. Additional anionic surfactants may include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

The one or more additional surfactants may be part of the surfactant component, as described above, or may be independent from the surfactant component. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the composition.

Water:

The detergent composition also includes water. Water is present in the composition in a total amount of from about 5 to about 15 weight percent based on a total weight of the composition. In various embodiments, the water is present in an amount of from about 5 to about 10, about 10 to about 15, or about 5, 6, 7, 8, 9, 10, 11, 12, 13, 14, or 15, weight percent based on a total weight of the composition. Typically, the terminology "total amount" refers to a total amount of water present in the composition from all components, i.e., not simply water added independently from, for example, the surfactant component and/or the rheology control agent. In various non-limiting embodiments, all values, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used.

Rheology Control Agent:

The composition also includes the rheology control agent which is present in an amount of from about 2 to about 15 weight percent actives based on a total weight of the detergent composition. In various embodiments, the rheology control agent is present in an amount of from about 3 to about 14, about 4 to about 13, about 5 to about 12, about 6 to about 11, about 7 to about 10, or about 8 to about 9, weight percent actives based on a total weight of the detergent composition. In other embodiments, the rheology control agent is present in an amount of 2, 3, 4, 5, 6, 7, 8, 9, 10, 11, 12, 13, 14, or 15, weight percent actives based on a total weight of the detergent composition. In still other embodiments, the rheology control agent is present in an amount of about 2.5 to about 12.5, about 2.5 to about 7.5, about 2.5 to about 5, about 5 to about 10, about 5 to about 7.5, about 7.5 to about 10, about 6.5 to about 12.5, about 7.5 to about 11.5, about 8.5 to about 10.5, or about 9.5 to about 10.5, weight percent actives based on a total weight of the detergent composition. In various non-limiting embodiments, all values, both whole and fractional, between and including all of the above, are hereby expressly contemplated for use herein.

The rheology control agent is not particularly limited and may be any known in the art. In one embodiment, the rheology control agent is a glycol ether. In various embodiments, the glycol ether is one or a combination of Ethylene glycol monomethyl ether (2-methoxyethanol, $CH_3OCH_2CH_2OH$); Ethylene glycol monoethyl ether (2-ethoxyethanol, $CH_3CH_2OCH_2CH_2OH$); Ethylene glycol monopropyl ether (2-propoxyethanol, $CH_3CH_2CH_2OCH_2CH_2OH$); Ethylene glycol monoisopropyl ether (2-isopropoxyethanol, $(CH_3)_2CHOCH_2CH_2OH$); Ethylene glycol monobutyl ether (2-butoxyethanol, $CH_3CH_2CH_2CH_2OCH_2CH_2OH$); Ethylene glycol monophenyl ether (2-phenoxyethanol, $C_6H_5OCH_2CH_2OH$); Ethylene glycol monobenzyl ether (2-benzyl oxy ethanol, $C_6H_5CH_2OCH_2CH_2OH$); Propylene glycol methyl ether, (1-methoxy-2-propanol, $CH_3OCH_2CH(OH)CH_3$); Diethylene glycol monomethyl ether (2-(2-methoxyethoxy)ethanol, methyl carbitol, $CH_3OCH_2CH_2OCH_2CH_2OH$); Diethylene glycol monoethyl ether (2-(2-ethoxyethoxy)ethanol, carbitol cellosolve, $CH_3CH_2OCH_2CH_2OCH_2CH_2OH$); Diethylene glycol mono-n-butyl ether (2-(2-butoxyethoxy)ethanol, butyl carbitol, $CH_3CH_2CH_2CH_2OCH_2CH_2OCH_2CH_2OH$); or Dipropyleneglycol methyl ether. In other embodiments, the glycol ether is chosen from butyl cellosolve, butyl carbitol, and combinations thereof. In one embodiment, the glycol either is butyl cellosolve. In another embodiment, the glycol ether is butyl carbitol. Moreover, the glycol either may be any one of the aforementioned compounds to the exclusion of any one or more of the aforementioned compounds. For example, the glycol ether may be butyl carbitol and be free of any other glycol ethers or be butyl cellosolve and be free of any other glycol ethers. In one embodiment, the glycol ether is present in an amount of from about 6.5 to about 12.5 weight percent actives based on a total weight of the detergent composition. In various embodiments, other suitable rheology control agent includes PEG 200, 300, 400, 600 and 800, and combinations thereof. In one embodiment, the rheology control agent is PEG 400. For example, the rheology control agent, e.g. the PEG, may have a weight average molecular weight of from about 180 to about 850 g/mol. In various other embodiments, the rheology control agent may have a weight average molecular weight of from about 190 to about 210, about 290 to about 310, about 390 to about 410, about 590 to about 610, about 790 to about 810, about 200, about 300, about 400, about 600, or about 800, g/mol. In various non-limiting embodiments, all values, both whole and fractional, between and including all of the above, are hereby expressly contemplated for use herein.

Additives:

The composition may include one or more of the following additives or may be free of one or more of the following additives. For example, the composition may include one or more foam inhibitors (e.g. defoaming agents). Suitable foam inhibitors include, but are not limited to, fatty acids such as coconut fatty acids. The composition may include the foam inhibitor at an amount of from about 0 to about 10 weight percent, based on the total weight of the composition. In one embodiment, the composition includes a defoaming agent and a neutralization agent. In various non-limiting embodiments, all values, both whole and fractional, between and including all of the above, are hereby expressly contemplated for use herein.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition. In various non-limiting embodiments, all values, both whole and fractional, between and including all of the above, are hereby expressly contemplated for use herein.

In other embodiments, additives may be or include neutralizers/pH adjustors just as monoethanolamine and the like, enzymes, optical brighteners, chelators, and combinations thereof. These additives may be chosen from any known in the art.

In one embodiment, the composition is free of, or includes less than 5, 4, 3, 2, 1, 0.5, or 0.1, weight percent of, a solvent other than water and the rheology control agent, e.g. an organic solvent, non-polar solvent, polar aprotic solvent, polar protic solvent, etc. and combinations thereof. In various non-limiting embodiments, all values, both whole and fractional, between and including all of the above, are hereby expressly contemplated for use herein.

Weight Percents/Ratios of Various Components:

The surfactant component, water, and rheology control agent are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

Physical Properties:

Typically, compositions that include alcohol ethoxy sulfates have viscosity issues upon dilution with water. However, the composition of the instant disclosure resists unwanted increases in viscosity upon dilution with water. For example, the composition of this disclosure has a viscosity of less than about 7,500 cps at 75° F. when diluted with additional water at about a 1:1 weight ratio of composition:water. In various embodiments, the viscosity is less than about 7,000, about 6,500, about 6,000, about 5,500, about 5,000, about 4,500, about 4,000, about 3,500, about 3,000, about 2,500, about 2,000, about 1,500, about 1,000, about 900, about 800, about 700, about 600, about 500, about 400, about 300, about 200, or about 100, cps at 75° F. when diluted with additional water at about a 1:1 weight ratio of composition:water.

In other embodiments, and as was introduced above, the viscosity is from about 100 to about 7,500, about 100 to about 500, about 100 to about 400, about 200 to about 300, about 200 to about 400, about 200 to about 500, about 300 to about 400, about 300 to about 500, or about 400 to about 500, cps at 75° F. when diluted with additional water at about a 1:1 weight ratio of composition:water. In other embodiments, the viscosity is from about 500 to about 7,500, about 1,000 to about 6,500, about 1,500 to about 6,000, about 2,000 to about 5,500, about 2,500 to about 5,000, about 3,000 to about 4,500, or about 3,500 to about 4,000, cps at 75° F. when diluted with additional water at about a 1:1 weight ratio of composition:water. In various non-limiting embodiments, all values, both whole and fractional, between and including all of the above, are hereby expressly contemplated for use herein.

The viscosity of the composition, e.g. those described above, may be measured using various techniques. For example, the viscosity may be measured using a Brookfield viscometer and any one or more spindles, as is chosen by one of skill in the art. In various embodiments, the composition has one or more of the aforementioned viscosities measured using a DV2T Brookfield viscometer at 20 rpm and 70° F. using spindle LV02(62). Alternatively, the viscosity may be described as being measured using a rheometer, e.g. any known in the art. In various embodiments, the composition has one or more of the aforementioned viscosities measured using an AR2000-EX Rheometer at a shear rate of 1.08 l/s at 75° F. with a geometry cone of 40 mm, 1:59:49 degree:min:sec, and a truncation gap of 52 microns. However, the shear rate, temperature, geometry cone, values for degree:min:sec, and truncation gap may all vary and be chosen by one of skill in the art. For example, the shear rate may be measured as is set forth in the Examples and Figures. In various non-limiting embodiments, all values, both whole and fractional, between and including all of the above, are hereby expressly contemplated for use herein.

Method of Forming the Detergent Composition:

This disclosure further provides a method of forming the detergent composition. The method includes the step of combining the surfactant component, water, and the rheology control agent and optionally any additional solvents, surfactants, additives, etc., to form the detergent composition. Each of the aforementioned components may be combined in any order and in whole or partial amounts. All orders of addition are hereby expressly contemplated for use in various non-limiting embodiments.

Liquid Laundry Embodiment and Unit Dose Embodiment

This disclosure also provides a liquid laundry embodiment. For example, the composition may include amounts of water and/or any of the other components suitable for a liquid laundry application, as understood by those of skill in the art. For example, a liquid laundry detergent may include the surfactant component described above that is present in an amount of from about 60 to about 75 weight percent actives based on a total weight of the detergent composition, about 3 to about 15 weight percent water based on a total weight of the detergent composition, and about 5 to about 15 weight percent actives of the rheology control agent based on a total weight of the detergent composition.

This disclosure also provides the unit dose embodiment. For example, the composition may include amounts of water and/or any of the other components suitable for a unit dose application, as understood by those of skill in the art. For example, a liquid laundry detergent may include the surfactant component described above that is present in an amount of from about 60 to about 75 weight percent actives based on a total weight of the detergent composition, about 3 to about 15 weight percent water based on a total weight of the detergent composition, and about 5 to about 15 weight percent actives of the rheology control agent based on a total weight of the detergent composition.

Typically, the differentiating feature between the liquid laundry embodiments and the unit dose embodiment is the delivery method. A unit dose embodiment is typically encapsulated in a film, as described below whereas the liquid laundry embodiment is typically provided in a bottle for use. In one embodiment, both the unit dose embodiment and the liquid laundry embodiment have the same compositions.

Unit Dose Pack:

This disclosure provides a unit dose pack that includes a pouch made of a water-soluble film and the detergent composition encapsulated within the pouch, such as the unit dose embodiment described above.

A unit dose pack can be formed by encapsulating the detergent composition within the pouch, wherein the pouch includes a film. In some embodiments, the film forms one half or more of the pouch, where the pouch may also include dyes or other components. In some embodiments, the film is water soluble such that the film will completely dissolve when an exterior of the film is exposed to water, such as in a washing machine typically used for laundry. When the film dissolves, the pouch is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values, both whole and fractional, between and including all of the above, are hereby expressly contemplated for use herein.

The unit dose pack may be formed from a pouch having a single section, but the unit dose pack may be formed from pouches with two or more different sections in alternate embodiments. In embodiments with a pouch having two or more sections, the contents of the different sections may or may not be the same.

Method of Forming Unit Dose Pack:

This disclosure also provides a method of forming the unit dose pack. The composition is typically first formed, e.g. using shear mixing. Shear mixing may be conducted using an over-the-head mixer such as an IKA RW 20 Digital Mixer at 500 rpm. The composition may then be encapsulated within a pouch by depositing the composition within the pouch. The pouch may then be sealed to encase and enclose the composition within the pouch to form the unit dose pack. The composition is typically in direct contact with the film of the pouch within the unit dose pack. The film of the pouch is typically sealable by heat, heat and water, ultrasonic methods, or other techniques, and one or more sealing techniques may be used to enclose the composition within the pouch.

EXAMPLES

Example 1

The following Design of Experiment was used to measure the effect of particular surfactants on viscosity in a detergent Composition. The units per formulation were dependent on the amount of Alcohol Ethoxy Sulfate and Linear Alkylbenzene Sulfonic Acid in each Composition, but the approximate active surfactant in each Composition ranged from about 55 to 75% active surfactant. Since the C12-C15 Alcohol Ethoxylate brought in no inactive matter as well as monoethanolamine, compositions that included larger amounts of C12-C15 Alcohol Ethoxylate had fewer overall units per Composition and a higher active surfactant level. For this reason, the Compositions do not add up to 100 units.

Table 1 below sets forth ratios of active levels of various surfactants of twenty concentrated compositions, i.e., Compositions 1-20. These correspond to various points set forth in the ternary plot of FIG. 2. More specifically, this Design of Experiment varied the use level of Linear Alkylbenzene Sulfonic Acid, C12-C15 Alcohol Ethoxylate with 7 moles of ethoxylation and Alcohol Ethoxy Sulfate (C12-C15 with 3 moles of ethoxylation). On an active basis, the sum of each surfactant added up to 40 units, with an additional 4 units coming from Coconut Fatty Acids, 6 units of water, and additional units coming from the inactive portion of Alcohol Ethoxy Sulfate (about 60% actives) as well as the units of monoethanolamine needed to neutralize the coconut fatty acid and Linear Alkylbenzene Sulfonic acid (with more units of monoethanolamine needed for formulas containing more Linear Alkylbenzene Sulfonic acid).

TABLE 1

| | Alcohol Ethoxy Sulfate | C12-C15 Alcohol Ethoxylate | Linear Alkylbenzene Sulfonic Acid |
|---|---|---|---|
| Composition 1 | 0.13107 | 0.81000 | 0.05893 |
| Composition 2 | 0.06435 | 0.34827 | 0.58738 |
| Composition 3 | 0.05952 | 0.05447 | 0.88601 |
| Composition 4 | 0.61717 | 0.32946 | 0.05337 |
| Composition 5 | 0.44609 | 0.21285 | 0.34106 |
| Composition 6 | 0.11047 | 0.42621 | 0.46332 |
| Composition 7 | 0.32107 | 0.56823 | 0.11070 |
| Composition 8 | 0.27771 | 0.22897 | 0.49332 |
| Composition 9 | 0.18385 | 0.61819 | 0.19796 |
| Composition 10 | 0.73699 | 0.08742 | 0.17559 |
| Composition 11 | 0.55698 | 0.25553 | 0.18749 |
| Composition 12 | 0.10033 | 0.19570 | 0.70397 |
| Composition 13 | 0.82976 | 0.11367 | 0.05656 |
| Composition 14 | 0.45457 | 0.44973 | 0.09570 |
| Composition 15 | 0.19813 | 0.05613 | 0.74574 |
| Composition 16 | 0.57987 | 0.07871 | 0.34143 |
| Composition 17 | 0.07361 | 0.59219 | 0.33420 |
| Composition 18 | 0.36172 | 0.07655 | 0.56172 |
| Composition 19 | 0.05179 | 0.75724 | 0.19097 |
| Composition 20 | 0.27980 | 0.40024 | 0.31996 |

The C12-C15 Alcohol Ethoxylate is a C12-C15 Alcohol Ethoxylate that is capped with approximately 7 moles of ethylene oxide.

Linear Alkylbenzene Sulfonic Acid is 2-Phenyl Sulfonic Acid.

Alcohol Ethoxy Sulfate is C12-C15 with 3 moles of ethoxylation.

Table 2 below sets forth additional components of the Compositions 1-20, i.e., the completed Compositions wherein all values are in weight percent. Notably, no viscosity control solvent or rheology control agent was added to Compositions 1-20 to lower the viscosity of the compositions and reduce thickness in any composition and difficulty in handling during a washing process. After formation, each is evaluated to determine viscosity at 75° F. using a AR2000-EX Rheometer at a shear rate of 1.08 l/s with a geometry cone of 40 mm, 1:59:49 degree:min:sec, and a truncation gap of 52 microns.

Composition 19 was further evaluated at a 1:1 by weight dilution with water and failed having a viscosity of about 60,000 cp at 75° F. determined using the same instrument and conditions above. The Compositions are deemed to "pass" if they exhibit a viscosity of less than about 7500 cP at 75° F. as determined using the aforementioned apparatus and conditions. However, Compositions having viscosities above about 7,500 cP at 75° F. as determined using the aforementioned apparatus and conditions are deemed to fail because they such viscosities tend to be too thick for consumer liking or processing. Results are set forth in FIG. 3.

TABLE 2

| | Comp. 1 | Comp. 2 | Comp. 3 | Comp. 4 | Comp. 5 |
|---|---|---|---|---|---|
| C12-C15 Alcohol Ethoxylate | 32.40 | 13.93 | 2.18 | 13.18 | 8.51 |
| Linear Alkylbenzene Sulfonic Acid | 2.36 | 23.50 | 35.44 | 2.13 | 13.64 |
| Coconut Oil Fatty Acid | 4.00 | 4.00 | 4.00 | 4.00 | 4.00 |
| Monoethanolamine | 1.16 | 4.97 | 7.12 | 1.12 | 3.20 |
| Alcohol Ethoxy Sulfate (60% Active) | 8.74 | 4.29 | 3.97 | 41.14 | 29.74 |
| Water | 6.00 | 6.00 | 6.00 | 6.00 | 6.00 |
| Total | 64.66 | 56.69 | 58.71 | 67.58 | 65.09 |
| Viscosity at 75° F., cp | 19,850 | 86,790 | 167,300 | 20,200 | 44,450 |

TABLE 2-continued

| | Comp. 6 | Comp. 7 | Comp. 8 | Comp. 9 | Comp. 10 |
|---|---|---|---|---|---|
| C12-C15 Alcohol Ethoxylate | 17.05 | 22.73 | 9.16 | 24.73 | 3.50 |
| Linear Alkylbenzene Sulfonic Acid | 18.53 | 4.43 | 19.73 | 7.92 | 7.02 |
| Coconut Oil Fatty Acid | 4.00 | 4.00 | 4.00 | 4.00 | 4.00 |
| Monoethanolamine | 4.08 | 1.54 | 4.29 | 2.17 | 2.00 |
| Alcohol Ethoxy Sulfate (60% Active) | 7.36 | 21.40 | 18.51 | 12.26 | 49.13 |
| Water | 6.00 | 6.00 | 6.00 | 6.00 | 6.00 |
| Total | 57.02 | 60.10 | 61.70 | 57.07 | 71.66 |
| Viscosity at 75° F., cp | 61,320 | 27,400 | 65,210 | 33,400 | 23,770 |

| | Comp. 11 | Comp. 12 | Comp. 13 | Comp. 14 | Comp. 15 |
|---|---|---|---|---|---|
| C12-C15 Alcohol Ethoxylate | 10.22 | 7.83 | 4.55 | 17.99 | 2.25 |
| Linear Alkylbenzene Sulfonic Acid | 7.50 | 28.16 | 2.26 | 3.83 | 29.83 |
| Coconut Oil Fatty Acid | 4.00 | 4.00 | 4.00 | 4.00 | 4.00 |
| Monoethanolamine | 2.09 | 5.81 | 1.15 | 1.43 | 6.11 |
| Alcohol Ethoxy Sulfate (60% Active) | 37.13 | 6.69 | 55.32 | 30.30 | 13.21 |
| Water | 6.00 | 6.00 | 6.00 | 6.00 | 6.00 |
| Total | 66.94 | 58.48 | 73.27 | 63.55 | 61.39 |
| Viscosity at 75° F., cp | 18,560 | 94,110 | 11,360 | 34,830 | 130,400 |

| | Comp. 16 | Comp. 17 | Comp. 18 | Comp. 19 | Comp. 20 |
|---|---|---|---|---|---|
| C12-C15 Alcohol Ethoxylate | 3.15 | 23.69 | 3.06 | 30.29 | 16.01 |
| Linear Alkylbenzene Sulfonic Acid | 13.66 | 13.37 | 22.47 | 7.64 | 12.80 |
| Coconut Oil Fatty Acid | 4.00 | 4.00 | 4.00 | 4.00 | 4.00 |
| Monoethanolamine | 3.20 | 3.15 | 4.78 | 2.11 | 3.04 |
| Alcohol Ethoxy Sulfate (60% Active) | 38.66 | 4.91 | 24.11 | 3.45 | 18.65 |
| Water | 6.00 | 6.00 | 6.00 | 6.00 | 6.00 |
| Total | 68.66 | 55.11 | 64.43 | 53.50 | 60.50 |
| Viscosity at 75° F., cp | 54,640 | 39,150 | 77,980 | 803* | 44,340 |

*Failed when diluted at 1:1 by weight with water by having a viscosity of about 60,000 cp at 75° F. as determined using the aforementioned apparatus and conditions.

Example 2

In a next series of Examples, 5 units of Butyl Carbitol were added to each of the Compositions 1-20 above, thereby forming Compositions 21-40, as set forth in Table 3 below. The ratios of active levels of various surfactants of Compositions 21-40 are the same as those for Compositions 1-20 and as set forth in Table 1 above.

After formation, each is evaluated to determine viscosity at Viscosity at 75° F., cp, using a AR2000-EX Rheometer at a shear rate of 1.08 l/s with a geometry cone of 40 mm, 1:59:49 degree:min:sec, and a truncation gap of 52 microns. These Compositions are deemed to "pass" if they exhibit a viscosity of less than about 7,500 cP at 75° F. as determined using the aforementioned apparatus and conditions. However, Compositions having viscosities above about 7,500 cP at 75° F. as determined using the aforementioned apparatus and conditions are deemed to fail because they such viscosities tend to be too thick for consumer liking or processing. If the Composition passed (undiluted), then the composition was diluted 1:1 by weight with water and then evaluated to determine viscosity at Viscosity at 75° F., cp, using a AR2000-EX Rheometer at a shear rate of 1.08 l/s with a geometry cone of 40 mm, 1:59:49 degree:min:sec, and a truncation gap of 52 microns. However, it is noted that even some of the Compositions that failed, undiluted, were still evaluated to determine viscosity after dilution, as set forth below. Results are set forth in FIG. 3.

TABLE 3

| | Comp. 21 | Comp. 22 | Comp. 23 | Comp. 24 | Comp. 25 |
|---|---|---|---|---|---|
| C12-C15 Alcohol Ethoxylate | 32.40 | 13.93 | 2.18 | 13.18 | 8.51 |
| Linear Alkylbenzene Sulfonic Acid | 2.36 | 23.50 | 35.44 | 2.13 | 13.64 |
| Coconut Oil Fatty Acid | 4.00 | 4.00 | 4.00 | 4.00 | 4.00 |
| Monoethanolamine | 1.16 | 4.97 | 7.12 | 1.12 | 3.20 |
| Alcohol Ethoxy Sulfate (60% Active) | 8.74 | 4.29 | 3.97 | 41.14 | 29.74 |

TABLE 3-continued

| | | | | | |
|---|---|---|---|---|---|
| Water | 6.00 | 6.00 | 6.00 | 6.00 | 6.00 |
| Butyl Carbitol | 5.00 | 5.00 | 5.00 | 5.00 | 5.00 |
| Total | 54.66 | 56.69 | 58.71 | 67.58 | 65.09 |
| Viscosity at 75° F., cp (undiluted) | 130 | 33940 | 121,300 | 318.9 | 35,050 |
| Viscosity at 75° F., cp (diluted 1:1 w/water) | 174.5 | Not Performed | Not Performed | 369,000 | Not Performed |

| | Comp. 26 | Comp. 27 | Comp. 28 | Comp. 29 | Comp. 30 |
|---|---|---|---|---|---|
| C12-C15 Alcohol Ethoxylate | 17.05 | 22.73 | 9.16 | 24.73 | 3.50 |
| Linear Alkylbenzene Sulfonic Acid | 18.53 | 4.43 | 19.73 | 7.92 | 7.02 |
| Coconut Oil Fatty Acid | 4.00 | 4.00 | 4.00 | 4.00 | 4.00 |
| Monoethanolamine | 4.08 | 1.54 | 4.29 | 2.17 | 2.00 |
| Alcohol Ethoxy Sulfate (60% Active) | 7.36 | 21.40 | 18.51 | 12.26 | 49.13 |
| Water | 6.00 | 6.00 | 6.00 | 6.00 | 6.00 |
| Butyl Carbitol | 5.00 | 5.00 | 5.00 | 5.00 | 5.00 |
| Total | 57.02 | 60.10 | 61.70 | 57.07 | 71.66 |
| Viscosity at 75° F., cp (undiluted) | 7198 | 93.42 | 46,950 | 130.9 | 24,840 |
| Viscosity at 75° F., cp (diluted 1:1 w/water) | Not Performed | 293,000 | Not Performed | 216,700 | 318,500 |

| | Comp. 31 | Comp. 32 | Comp. 33 | Comp. 34 | Comp. 35 |
|---|---|---|---|---|---|
| C12-C15 Alcohol Ethoxylate | 10.22 | 7.83 | 4.55 | 17.99 | 2.25 |
| Linear Alkylbenzene Sulfonic Acid | 7.50 | 28.16 | 2.26 | 3.83 | 29.83 |
| Coconut Oil Fatty Acid | 4.00 | 4.00 | 4.00 | 4.00 | 4.00 |
| Monoethanolamine | 2.09 | 5.81 | 1.15 | 1.43 | 6.11 |
| Alcohol Ethoxy Sulfate (60% Active) | 37.13 | 6.69 | 55.32 | 30.30 | 13.21 |
| Water | 6.00 | 6.00 | 6.00 | 6.00 | 6.00 |
| Butyl Carbitol | 5.00 | 5.00 | 5.00 | 5.00 | 5.00 |
| Total | 66.94 | 58.48 | 73.27 | 63.55 | 61.39 |
| Viscosity at 75° F., cp (undiluted) | 20,300 | 69,950 | 1303 | 195.8 | 101,200 |
| Viscosity at 75° F., cp (diluted 1:1 w/water) | 265,900 | Not Performed | 369,900 | 330,600 | Not Performed |

| | Comp. 36 | Comp. 37 | Comp. 38 | Comp. 39 | Comp. 40 |
|---|---|---|---|---|---|
| C12-C15 Alcohol Ethoxylate | 3.15 | 23.69 | 3.06 | 30.29 | 16.01 |
| Linear Alkylbenzene Sulfonic Acid | 13.66 | 13.37 | 22.47 | 7.64 | 12.80 |
| Coconut Oil Fatty Acid | 4.00 | 4.00 | 4.00 | 4.00 | 4.00 |
| Monoethanolamine | 3.20 | 3.15 | 4.78 | 2.11 | 3.04 |
| Alcohol Ethoxy Sulfate (60% Active) | 38.66 | 4.91 | 24.11 | 3.45 | 18.65 |
| Water | 6.00 | 6.00 | 6.00 | 6.00 | 6.00 |
| Butyl Carbitol | 5.00 | 5.00 | 5.00 | 5.00 | 5.00 |
| Total | 68.66 | 55.11 | 64.43 | 53.50 | 60.50 |
| Viscosity at 75° F., cp (undiluted) | 43,140 | 139.5* | 52,330 | 118.7* | 3283 |
| Viscosity at 75° F., cp (diluted 1:1 w/water) | Not Performed | 0.4818* | Not Performed | 6.219* | 58,180 |

*Compositions 37 and 39 passed viscosity tests both as undiluted and diluted compositions.

Example 3

In a next series of Examples, 7.5 units of Butyl Carbitol were added to each of the Compositions 1-20 above, thereby forming Compositions 41-60, as set forth in Table 4 below. The ratios of active levels of various surfactants of Compositions 41-60 are the same as those for Compositions 1-20 and as set forth in Table 1 above.

After formation, each is evaluated to determine viscosity at Viscosity at 75° F., cp, using a AR2000-EX Rheometer at a shear rate of 1.08 l/s with a geometry cone of 40 mm, 1:59:49 degree:min:sec, and a truncation gap of 52 microns. The Compositions are then diluted 1:1 by weight with water and then evaluated to determine viscosity at Viscosity at 75° F., cp, using a AR2000-EX Rheometer at a shear rate of 1.08 l/s with a geometry cone of 40 mm, 1:59:49 degree:min:sec, and a truncation gap of 52 microns. The Compositions are deemed to "pass" if they exhibit a viscosity of less than about 7,500 cP at 75° F. as determined using the aforementioned apparatus and conditions. However, Compositions having viscosities above about 7,500 cP at 75° F. as determined using the aforementioned apparatus and conditions are deemed to fail because they such viscosities tend to be too thick for consumer liking or processing. Results are set forth in FIG. 3.

TABLE 4

| | Comp. 41 | Comp. 42 | Comp. 43 | Comp. 44 | Comp. 45 |
|---|---|---|---|---|---|
| C12-C15 Alcohol Ethoxylate | 32.40 | 13.93 | 2.18 | 13.18 | 8.51 |
| Linear Alkylbenzene Sulfonic Acid | 2.36 | 23.50 | 35.44 | 2.13 | 13.64 |
| Coconut Oil Fatty Acid | 4.00 | 4.00 | 4.00 | 4.00 | 4.00 |
| Monoethanolamine | 1.16 | 4.97 | 7.12 | 1.12 | 3.20 |
| Alcohol Ethoxy Sulfate (60% Active) | 8.74 | 4.29 | 3.97 | 41.14 | 29.74 |
| Water | 6.00 | 6.00 | 6.00 | 6.00 | 6.00 |
| Butyl Carbitol | 7.50 | 7.50 | 7.50 | 7.50 | 7.50 |
| Total | 54.66 | 56.69 | 58.71 | 67.58 | 65.09 |
| Viscosity at 75° F., cp (undiluted) | 90.58 | 321.7* | 99,170 | 80.3 | 19,790 |
| Viscosity at 75° F., cp (diluted 1:1 w/water) | 156,300 | 259* | 2,651 | 306,600 | 12,110 |

| | Comp. 46 | Comp. 47 | Comp. 48 | Comp. 49 | Comp. 50 |
|---|---|---|---|---|---|
| C12-C15 Alcohol Ethoxylate | 17.05 | 22.73 | 9.16 | 24.73 | 3.50 |
| Linear Alkylbenzene Sulfonic Acid | 18.53 | 4.43 | 19.73 | 7.92 | 7.02 |
| Coconut Oil Fatty Acid | 4.00 | 4.00 | 4.00 | 4.00 | 4.00 |
| Monoethanolamine | 4.08 | 1.54 | 4.29 | 2.17 | 2.00 |
| Alcohol Ethoxy Sulfate (60% Active) | 7.36 | 21.40 | 18.51 | 12.26 | 49.13 |
| Water | 6.00 | 6.00 | 6.00 | 6.00 | 6.00 |
| Butyl Carbitol | 7.50 | 7.50 | 7.50 | 7.50 | 7.50 |
| Total | 57.02 | 60.10 | 61.70 | 57.07 | 71.66 |
| Viscosity at 75° F., cp (undiluted) | 135.6* | 106.4 | 28,480 | 139.7 | 8,900 |
| Viscosity at 75° F., cp (diluted 1:1 w/water) | 254* | 266,600 | 619 | 280,000 | 270,000 |

| | Comp. 51 | Comp. 52 | Comp. 53 | Comp. 54 | Comp. 55 |
|---|---|---|---|---|---|
| C12-C15 Alcohol Ethoxylate | 10.22 | 7.83 | 4.55 | 17.99 | 2.25 |
| Linear Alkylbenzene Sulfonic Acid | 7.50 | 28.16 | 2.26 | 3.83 | 29.83 |
| Coconut Oil Fatty Acid | 4.00 | 4.00 | 4.00 | 4.00 | 4.00 |
| Monoethanolamine | 2.09 | 5.81 | 1.15 | 1.43 | 6.11 |
| Alcohol Ethoxy Sulfate (60% Active) | 37.13 | 6.69 | 55.32 | 30.30 | 13.21 |
| Water | 6.00 | 6.00 | 6.00 | 6.00 | 6.00 |
| Butyl Carbitol | 7.50 | 7.50 | 7.50 | 7.50 | 7.50 |
| Total | 66.94 | 58.48 | 73.27 | 63.55 | 61.39 |
| Viscosity at 75° F., cp (undiluted) | 805.3 | 48,440 | 292.3 | 110.1 | 74,660 |
| Viscosity at 75° F., cp (diluted 1:1 w/water) | 260,000 | 580 | 275,000 | 280,000 | 1220 |

| | Comp. 56 | Comp. 57 | Comp. 58 | Comp. 59 | Comp. 60 |
|---|---|---|---|---|---|
| C12-C15 Alcohol Ethoxylate | 3.15 | 23.69 | 3.06 | 30.29 | 16.01 |
| Linear Alkylbenzene Sulfonic Acid | 13.66 | 13.37 | 22.47 | 7.64 | 12.80 |
| Coconut Oil Fatty Acid | 4.00 | 4.00 | 4.00 | 4.00 | 4.00 |
| Monoethanolamine | 3.20 | 3.15 | 4.78 | 2.11 | 3.04 |
| Alcohol Ethoxy Sulfate (60% Active) | 38.66 | 4.91 | 24.11 | 3.45 | 18.65 |
| Water | 6.00 | 6.00 | 6.00 | 6.00 | 6.00 |
| Butyl Carbitol | 7.50 | 7.50 | 7.50 | 7.50 | 7.50 |
| Total | 68.66 | 55.11 | 64.43 | 53.50 | 60.50 |
| Viscosity at 75° F., cp (undiluted) | 36,370 | 126.2* | 44,900 | 103.8* | 109.9* |
| Viscosity at 75° F., cp (diluted 1:1 w/water) | 28,130 | 320* | 384 | 6,700* | 600* |

*Compositions 42, 46, 57, 59 and 60 passed viscosity tests both as undiluted and diluted compositions.

Example 4

In a next series of Examples, 5 units of Butyl Cellosolve were added to each of the Compositions 1-20 above instead of 5 units of Butyl Carbitol, thereby repeating Example 2 using Butyl Cellosolve and forming Compositions 61-80, as set forth in Table 5 below. The ratios of active levels of various surfactants of Compositions 61-80 are the same as those for Compositions 1-20 and as set forth in Table 1 above.

After formation, each is evaluated to determine viscosity at Viscosity at 75° F., cp, using a AR2000-EX Rheometer at a shear rate of 1.08 l/s with a geometry cone of 40 mm, 1:59:49 degree:min:sec, and a truncation gap of 52 microns. The Compositions are then diluted 1:1 by weight with water and then evaluated to determine viscosity at Viscosity at 75° F., cp, using a AR2000-EX Rheometer at a shear rate of 1.08 l/s with a geometry cone of 40 mm, 1:59:49 degree:min:sec, and a truncation gap of 52 microns. The Compositions are deemed to "pass" if they exhibit a viscosity of less than about 7,500 cP at 75° F. as determined using the aforementioned apparatus and conditions. However, Compositions having viscosities above about 7,500 cP at 75° F. as determined using the aforementioned apparatus and conditions are deemed to fail because they such viscosities tend to be too thick for consumer liking or processing. These viscosities are also set forth in Table 5 below. Results are set forth in FIG. 4.

TABLE 5

| | Comp. 61 | Comp. 62 | Comp. 63 | Comp. 64 | Comp. 65 |
|---|---|---|---|---|---|
| C12-C15 Alcohol Ethoxylate | 32.40 | 13.93 | 2.18 | 13.18 | 8.51 |
| Linear Alkylbenzene Sulfonic Acid | 2.36 | 23.50 | 35.44 | 2.13 | 13.64 |
| Coconut Oil Fatty Acid | 4.00 | 4.00 | 4.00 | 4.00 | 4.00 |
| Monoethanolamine | 1.16 | 4.97 | 7.12 | 1.12 | 3.20 |
| Alcohol Ethoxy Sulfate (60% Active) | 8.74 | 4.29 | 3.97 | 41.14 | 29.74 |
| Water | 6.00 | 6.00 | 6.00 | 6.00 | 6.00 |
| Butyl Cellosolve | 5.00 | 5.00 | 5.00 | 5.00 | 5.00 |
| Total | 54.66 | 56.69 | 58.71 | 67.58 | 65.09 |
| Viscosity at 75° F., cp (undiluted) | 95 | 2,610* | 98,780 | 250 | 28,400 |
| Viscosity at 75° F., cp (diluted 1:1 w/water) | 80,000 | 310* | 770 | 180,000 | 645 |

| | Comp. 66 | Comp. 67 | Comp. 68 | Comp. 69 | Comp. 70 |
|---|---|---|---|---|---|
| C12-C15 Alcohol Ethoxylate | 17.05 | 22.73 | 9.16 | 24.73 | 3.50 |
| Linear Alkylbenzene Sulfonic Acid | 18.53 | 4.43 | 19.73 | 7.92 | 7.02 |
| Coconut Oil Fatty Acid | 4.00 | 4.00 | 4.00 | 4.00 | 4.00 |
| Monoethanolamine | 4.08 | 1.54 | 4.29 | 2.17 | 2.00 |
| Alcohol Ethoxy Sulfate (60% Active) | 7.36 | 21.40 | 18.51 | 12.26 | 49.13 |
| Water | 6.00 | 6.00 | 6.00 | 6.00 | 6.00 |
| Butyl Cellosolve | 5.00 | 5.00 | 5.00 | 5.00 | 5.00 |
| Total | 57.02 | 60.10 | 61.70 | 57.07 | 71.66 |
| Viscosity at 75° F., cp (undiluted) | 1,760* | 100 | 34,890 | 100 | 14,000 |
| Viscosity at 75° F., cp (diluted 1:1 w/water) | 2,290* | 150,000 | 1,000 | 100,000 | 200,000 |

| | Comp. 71 | Comp. 72 | Comp. 73 | Comp. 74 | Comp. 75 |
|---|---|---|---|---|---|
| C12-C15 Alcohol Ethoxylate | 10.22 | 7.83 | 4.55 | 17.99 | 2.25 |
| Linear Alkylbenzene Sulfonic Acid | 7.50 | 28.16 | 2.26 | 3.83 | 29.83 |
| Coconut Oil Fatty Acid | 4.00 | 4.00 | 4.00 | 4.00 | 4.00 |
| Monoethanolamine | 2.09 | 5.81 | 1.15 | 1.43 | 6.11 |
| Alcohol Ethoxy Sulfate (60% Active) | 37.13 | 6.69 | 55.32 | 30.30 | 13.21 |
| Water | 6.00 | 6.00 | 6.00 | 6.00 | 6.00 |
| Butyl Cellosolve | 5.00 | 5.00 | 5.00 | 5.00 | 5.00 |
| Total | 66.94 | 58.48 | 73.27 | 63.55 | 61.39 |
| Viscosity at 75° F., cp (undiluted) | 6,370 | 57,500 | 360 | 230 | 75,800 |
| Viscosity at 75° F., cp (diluted 1:1 w/water) | 180,000 | 6,560 | 200,000 | 200,000 | 9,780 |

| | Comp. 76 | Comp. 77 | Comp. 78 | Comp. 79 | Comp. 80 |
|---|---|---|---|---|---|
| C12-C15 Alcohol Ethoxylate | 3.15 | 23.69 | 3.06 | 30.29 | 16.01 |
| Linear Alkylbenzene Sulfonic Acid | 13.66 | 13.37 | 22.47 | 7.64 | 12.80 |
| Coconut Oil Fatty Acid | 4.00 | 4.00 | 4.00 | 4.00 | 4.00 |
| Monoethanolamine | 3.20 | 3.15 | 4.78 | 2.11 | 3.04 |
| Alcohol Ethoxy Sulfate (60% Active) | 38.66 | 4.91 | 24.11 | 3.45 | 18.65 |

TABLE 5-continued

| | | | | | |
|---|---|---|---|---|---|
| Water | 6.00 | 6.00 | 6.00 | 6.00 | 6.00 |
| Butyl Cellosolve | 5.00 | 5.00 | 5.00 | 5.00 | 5.00 |
| Total | 68.66 | 55.11 | 64.43 | 53.50 | 60.50 |
| Viscosity at 75° F., cp (undiluted) | 36,300 | 122* | 50,500 | 100* | 17,230 |
| Viscosity at 75° F., cp (diluted 1:1 w/water) | 1,530 | 290* | 310 | 330* | 360 |

*Compared to Example 2, Butyl Cellosolve was much more efficient at controlling rheology as-is and at 1:1 dilution as shown relative to Compositions 62, 66, 77, and 79 which passed viscosity tests both as undiluted and diluted compositions.

FIG. 1 is a ternary plot of weight ratios of actives of three surfactants of the surfactant component of the instant disclosure showing a four-sided region (A) and a four-sided region (B) that is further described in the Examples.

Figure 2:
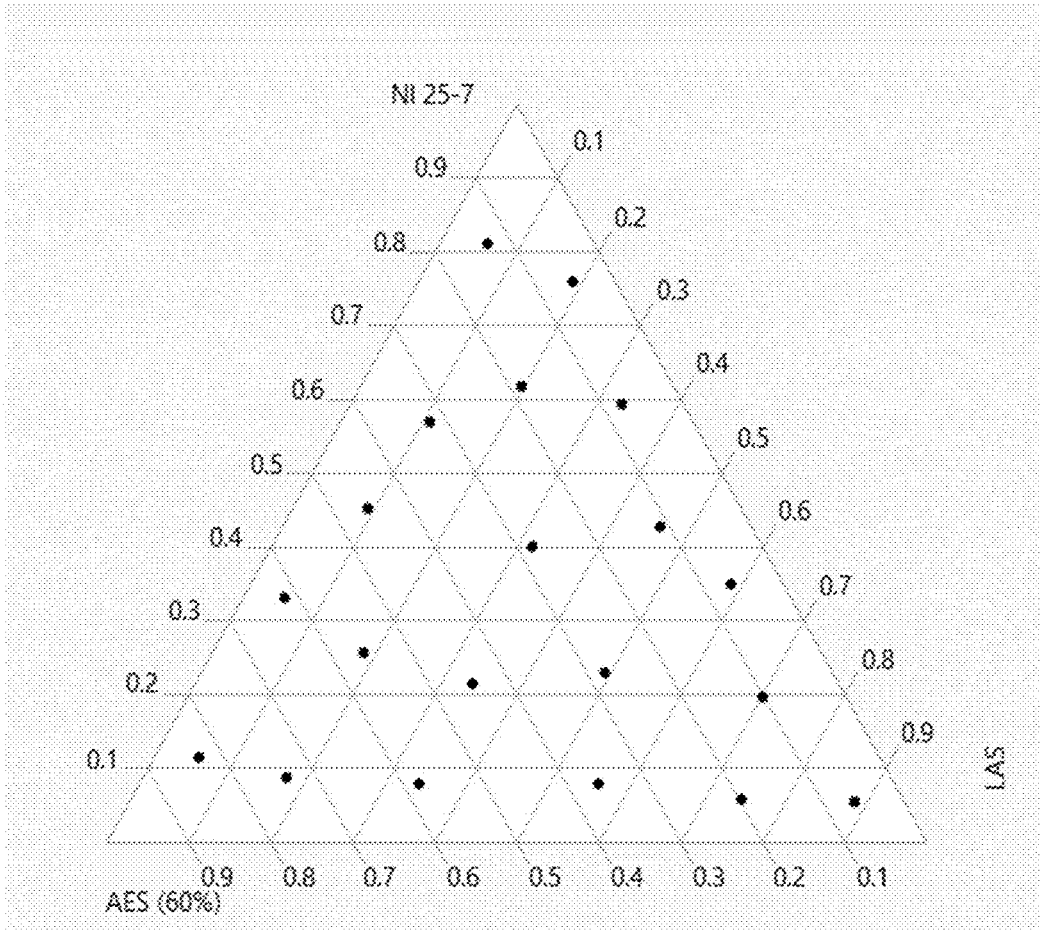
FIG. 2 is a ternary plot of weight ratios of actives of three surfactants of the surfactant component of the instant disclosure as described in various examples.

FIG. 2 is a ternary plot of weight ratios of actives of three surfactants of the surfactant component of the instant disclosure as described in various examples. In other words, FIG. 2 is a ternary plot explains the general formula space.

Figure 3:
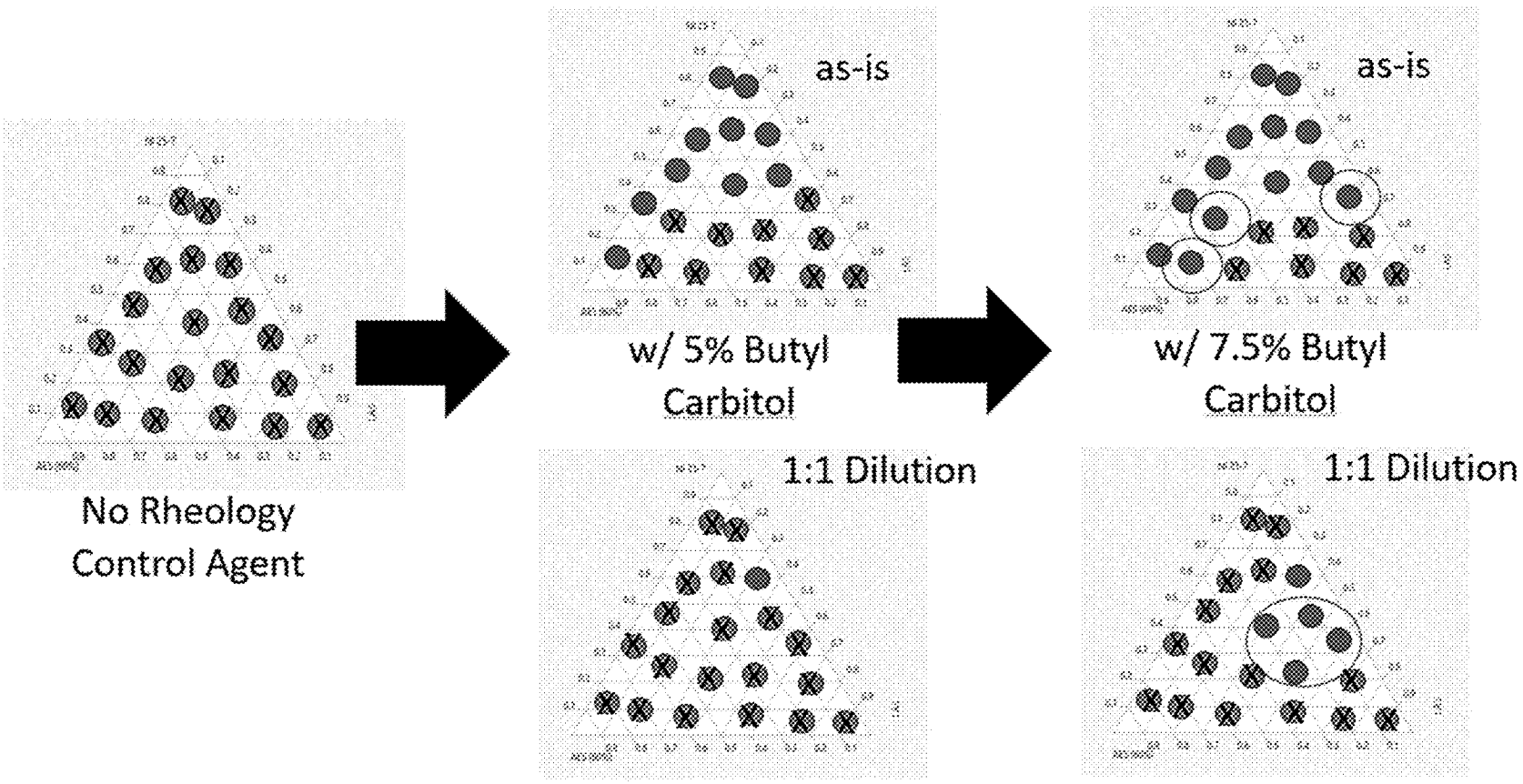
FIG. 3 is a series of ternary plots of weight ratios of actives of three surfactants of the surfactant component of the instant disclosure that include varying amounts of butyl carbitol both before and after dilution wherein circles that include an "x" represent failed compositions due to high viscosity and circles without an "x", and those circles that are themselves circled, represent compositions that have viscosities of less than about 7,500 cps at 75° F.

FIG. 3 is a series of ternary plots of weight ratios of actives of three surfactants of the surfactant component of the instant disclosure that include butyl carbitol both before and after dilution.

Figure 4:
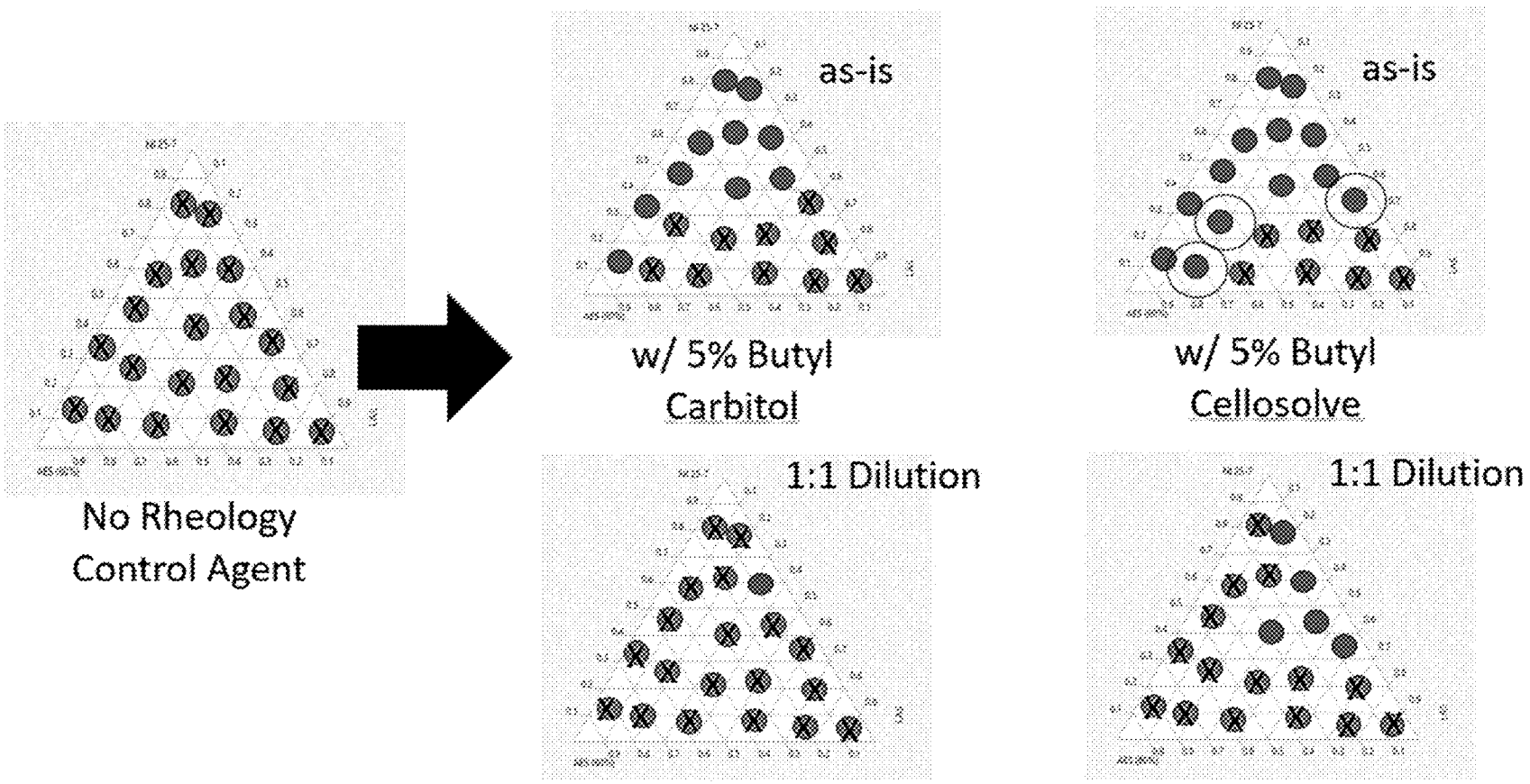
FIG. 4 is a series of ternary plots of weight ratios of actives of three surfactants of the surfactant component of the instant disclosure that include varying amounts of butyl cellosolve both before and after dilution wherein circles that include an "x" represent failed compositions due to high viscosity and circles without an "x", and those circles that are themselves circled, represent compositions that have viscosities of less than about 7,500 cps at 75° F.

FIG. 4 is a series of ternary plots of weight ratios of actives of three surfactants of the surfactant component of the instant disclosure that include butyl cellosolve both before and after dilution. In other words, FIGS. 3 and 4 show viscosity results both before and after dilution with various types and amounts of the rheology control agent. They indicated which portions of the aforementioned designs of experiment were successful and which failed.

The ternary plot of FIG. 4 indicates regions that pass both the as-is and dilution rheology requirements as well as a region that only passes the dilution rheology requirements for the Compositions including 5 units of Butyl Cellosolve. Preferred regions are larger if the use-level of glycol ethers is increased. However, in such embodiments, the concentration factor will decrease since there will be more solvent vs. surfactant ratio. Therefore, butyl cellosolve is more effective glycol ether to both control viscosity and keep concentrations high.

Moreover, according to the various designs of experiment described above, the region A, and also B, of the ternary plot shows the highest concentration of surfactant that can be used while simultaneously providing rheology control (e.g. as a liquid composition and for a diluted liquid composition). It is believed that these proportions of surfactants plus the rheology control agent allow for a detergent product to be made that is particularly useful in consumer applications because of minimized/eliminated an uncontrolled rheology change which would otherwise lead to poor cleaning.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A unit dose detergent pack comprising:

a pouch made of a water-soluble film; and a detergent composition encapsulated within said pouch, wherein said detergent composition comprises:

A. a surfactant component present in an amount of about 55 to about 85 weight percent actives based on a total weight of said detergent composition and consisting of;

(1) an alcohol ethoxy sulfate having a $C_8$-$C_{20}$ backbone that is ethoxylated with from about 1 to about 10 moles of ethylene oxide;

(2) at least one non-ionic surfactant comprising an alkoxylated alcohol; and (3) at least one anionic surfactant comprising a linear alkylbenzene sulfonate;

B. water present in a total amount of from about 5 to about 15 weight percent based on a total weight of said detergent composition; and C. a rheology control agent present in an amount of from about 5 to about 7.5 weight percent actives based on a total weight of said detergent composition and chosen from butyl cellosolve, butyl carbitol, and combinations thereof, wherein said detergent composition has a viscosity of less than about 7,500 cps at 75° F. when diluted with additional water at about a 1:1 weight ratio of detergent composition:water; and wherein said (1) alcohol ethoxy sulfate is sodium laureth sulfate ethoxylated with about 2 to about 4 moles of ethylene oxide, said (2) alkoxylated alcohol is a C12-C15 alcohol ethoxylate; and said (3) linear alkyl benzenesulfonate is 2-dodecylbenzene sulfonate;

wherein:

the weight ratio of actives of (1), (2), and (3) falls within a four-sided region (A) of a ternary plot, wherein the four-sided region (A) is defined by four points of the ratio of (1):(2):(3) as follows:

(i) (0):(0.9):(0.1);

(ii) (0.2):(0.8):(0);

(iii) (0.2):(0.15):(0.65); and (iv) (0):(0.25):(0.75);

or the weight ratio of actives of (1), (2), and (3) falls within a four-sided region (B) of a ternary plot, wherein the four-sided region (B) is defined by four points of the ratio of (1):(2):(3) as follows:

(v) (0.2):(0.65):(0.15);

(vi) (0.5):(0.4):(0.1);

(vii) (0.5):(0.05):(0.45); and (viii) (0.2):(0.15):(0.65).

2. The unit dose detergent pack of claim 1 wherein the weight ratio of actives of (1), (2), and (3) are: (0.05):(0.76):(0.19).

3. The unit dose detergent pack of claim 1 wherein the weight ratio of actives of (1), (2), and (3) are: (0.07):(0.59):(0.33).

4. The unit dose detergent pack of claim 1 wherein the weight ratio of actives of (1), (2), and (3) are: (0.11):(0.43):(0.46).

5. The unit dose detergent pack of claim 1 wherein the weight ratio of actives of (1), (2), and (3) are: (0.06):(0.35):(0.59).

6. The unit dose detergent pack of claim 1 wherein the weight ratio of actives of (1), (2), and (3) are: (0.28):(0.40):(0.32).

7. The unit dose detergent pack of claim 1 wherein the weight ratio of actives of (1), (2), and (3) are: (0.28):(0.23):(0.49).

8. The unit dose detergent pack of claim 1 wherein the weight ratio of actives of (1), (2), and (3) are: (0.45):(0.21):(0.34).

9. The unit dose detergent pack of claim 1 further comprising a polyethylene glycol having a weight average molecular weight of from about 190 to about 850 g/mol.

10. A detergent composition consisting of:

A. a surfactant component present in an amount of about 55 to about 85 weight percent actives based on a total weight of said detergent composition and consisting of:
   (1) an alcohol ethoxy sulfate having a $C_8$-$C_{20}$ backbone that is ethoxylated with from about 1 to about 10 moles of ethylene oxide;
   (2) at least one non-ionic surfactant comprising an alkoxylated alcohol; and
   (3) at least one anionic surfactant comprising a linear alkylbenzene sulfonate;

B. water present in a total amount of from about 5 to about 15 weight percent based on a total weight of said detergent composition; and C. a rheology control agent present in an amount of from about 5 to about 7.5 weight percent actives based on a total weight of said detergent composition and chosen from butyl cellosolve, butyl carbitol, and combinations thereof, wherein said detergent composition has a viscosity of less than about 7,500 cps at 75° F. when diluted with additional water at about a 1:1 weight ratio of detergent composition:water; and wherein said (1) alcohol ethoxy sulfate is sodium laureth sulfate ethoxylated with about 2 to about 4 moles of ethylene oxide, said (2) alkoxylated alcohol is a C12-C15 alcohol ethoxylate; and said (3) linear alkyl benzenesulfonate is 2-dodecylbenzene sulfonate;

wherein:

the weight ratio of actives of (1), (2), and (3) falls within a four-sided region (A) of a ternary plot, wherein the four-sided region (A) is defined by four points of the ratio of (1):(2):(3) as follows:

(i) (0):(0.9):(0.1);
(ii) (0.2):(0.8):(0);
(iii) (0.2):(0.15):(0.65); and
(iv) (0):(0.25):(0.75);

or the weight ratio of actives of (1), (2), and (3) falls within a four-sided region (B) of a ternary plot, wherein the four-sided region (B) is defined by four points of the ratio of (1):(2):(3) as follows:

(v) (0.2):(0.65):(0.15);
(vi) (0.5):(0.4):(0.1);
(vii) (0.5):(0.05):(0.45); and
(viii) (0.2):(0.15):(0.65).

11. The unit dose detergent pack of claim 1 wherein the detergent composition consists essentially of (A), (B), and (C).

12. The unit dose detergent pack of claim 1 wherein the detergent composition consists of (A), (B), and (C).

* * * * *